United States Patent [19]

Feingold et al.

[11] 4,051,403

[45] Sept. 27, 1977

[54] CHANNEL PLATE MULTIPLIER HAVING HIGHER SECONDARY EMISSION COEFFICIENT NEAR INPUT

[75] Inventors: Robert M. Feingold, Annandale; Carl W. Hoover, Jr., Woodbridge; John Rennie, Alexandria, all of Va.

[73] Assignee: The United States of America as represented by the Secretary of the Army, Washington, D.C.

[21] Appl. No.: 713,165

[22] Filed: Aug. 10, 1976

[51] Int. Cl.[2] ..... H01J 43/22; H01J 43/24

[52] U.S. Cl. ..... 313/105 CM; 427/78

[58] Field of Search ..... 313/105 CM, 103 CM

[56] References Cited

U.S. PATENT DOCUMENTS

| | | | |
|---|---|---|---|
| 3,400,291 | 9/1968 | Sheldon | 313/105 CM X |
| 3,491,233 | 1/1970 | Manley | 313/105 CM X |
| 3,519,870 | 7/1970 | Jensen | 313/105 CM |
| 3,879,626 | 4/1975 | Washington et al. | 313/105 CM |
| 3,911,167 | 10/1975 | Linder | 313/105 CM X |
| 3,974,411 | 8/1976 | Faulkner et al. | 313/105 CM |

*Primary Examiner*—Robert Segal

*Attorney, Agent, or Firm*—Nathan Edelberg; John E. Holford; Robert E. Gibson

[57] ABSTRACT

An improved microchannel plate is provided by adding a coating or coatings to the input end of the channels which have a much higher second emission coefficient than the material which forms the body of the plate.

4 Claims, 2 Drawing Figures

CHANNEL PLATE MULTIPLIER HAVING HIGHER SECONDARY EMISSION COEFFICIENT NEAR INPUT

The invention described herein may be manufactured, used, and licensed by the United States Government for governmental purposes without the payment of any royalties thereon.

BACKGROUND OF THE INVENTION

Electron multipliers have been developed in a variety of forms over the years. In its simplest form it can be made as a single channel device in a vacuum envelope, having an input and output electrode to produce a linear accelerating electric field, a generally tubular channel member, the inner surface of which is capable of a secondary electron yield greater than 1. Another essential property of the channel is a fair conductivity which insures that electrons removed from the walls by secondary emission are promptly replaced but which is low enough to support the required electric field along the channel without drawing excessive current.

Other factors which have received considerable attention are the angle of the walls relative to the electric field lines and the problem of positive ion generation due mostly to impurities in the tube. These factors are interrelated fortunately, so that increasing the angle both increases the probability of the electron hitting the tube and decreases the probability of the positive ion hitting the cathode before striking the tube. Periodically reversing the angle of bend has also been employed to enhance these probabilities. These techniques are fairly simple with a single channel device, but became rather complicated when numerous channels with fixed geometric relationships between the inputs and outputs are involved. Such a device is the microchannel plate (see U.S. Pat. Nos. 3,497,759 and 3,528,101 granted Feb. 24, 1970 and Sept. 8, 1970 to B. W. Manley).

The microchannel plate is formed from a plurality of glass pipes or hollow fibers which are heated as a bundle and drawn to microscopic diameters. A limited amount of twisting can accompany the drawing operation to achieve angular relationships as discussed above, but this cannot be allowed to disturb significantly the relative positions of the fibers or their cross-sectional shape. Such twisting probably would be sufficient if the fibers were made from a material having a very high coefficient of secondary emission. Unfortunately the best glass from the standpoints of ease of fabrication and cost have rather low coefficients. Thus, added to uncertainty of when the first collision between the wall and the electron will occur, is the uncertainty that a significant number of secondary electrons will be emitted whenever such a collision occurs. The electron causing the avalanche may itself be initiated by secondary electron emission, ion induced electron emission, photoemission, or other initiating event capable of liberating an electron into a vacuum.

The function of a typical electron-multiplier device is that of producing a large number of electrons at the output on receipt of an initiating event. In order that the device may be an efficient detector, the probability of not responding to an event must be small. Further, if the device is to be used as a linear amplifier, the size of the output pulse must be uniform. A measure of the spread in pulse sizes is the resolution of the device. A device with high resolution contributes little noise to the signal.

These two attributes of a multiplier, detection efficiency and resolution, combine to produce a signal such that the contrast between a weak and a strong source is reduced. In an image tube, this results in a reduction in the range at which an object can be seen, at constant light level. In a pulse detector it means a loss in amplitude discrimination between pulses. In a pulse counter, a low detection efficiency results in some fraction of input pulses not being detected at all.

BRIEF DESCRIPTION OF THE INVENTION

The object of the present invention is to provide an improved electron multiplier by altering the input end of each channel therein so as to increase the probability of obtaining a significant number of secondary electrons from the first collision of the primary electron with the channel wall.

A further object of the invention to alter the input of each channel in the manner indicated above by coating a portion only of the channel with a material chosen solely for its high coefficient of secondary emission.

More specifically, it is an object to apply the above teachings to a microchannel plate type of electron multiplier wherein the cross sections of the channels are microscopic and the channel lengths are orders of magnitude greater than their cross-section.

BRIEF DESCRIPTION OF THE DRAWINGS

The invention is best understood with reference to the drawing wherein.

DESCRIPTION OF THE INVENTION

Figure 1:
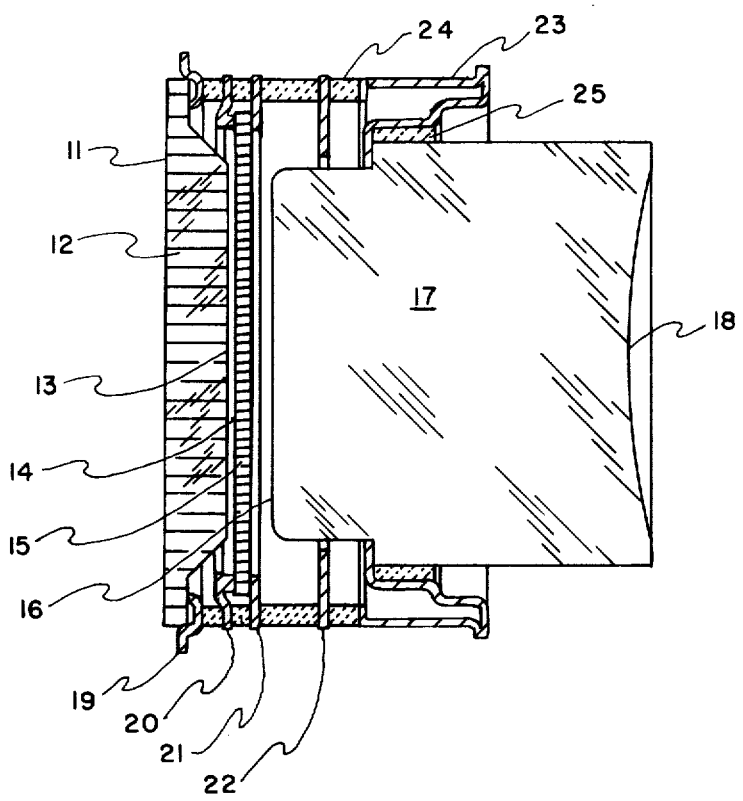
FIG. 1 shows a cross-sectional view of an image intensifier tube employing a microchannel plate according to the present invention as an electron multiplier.

Referring specifically to FIG. 1, there is shown a typical structure in which applicant's invention can be used. This device, which is known as an image intensifier is a generally cylindrical electronic vacuum tube structure. One circular end is closed by a faceplate 11 composed of tiny optical fibers 12 arranged normal to the opposite surfaces thereof, so that a light image projected on the external surface will be conducted to the inner surface with a resolution of the order of the diameter of the fibers. The inner surface of the faceplate is coated with a photoemissive cathode layer 13. The opposite end of the tube is closed by another fiber optic member 17 known as an inverter. It is similar to the faceplate 11 except that the fibers are twisted to provide an inversion of a light image passing therethrough, which also accounts for its greater thickness. The inner surface of the inverter is covered by a fluorescent screen 16 the extremely thin metal backing of which serves as the tube anode. An electron multiplier in the form of a microchannel plate 14 is inserted between the photocathode 11 and anode structure 17. Each of the three aforementioned structures have similar very thin conductive layers on or near their adjacent surfaces and are electrically connected thereby to external tube terminals 19, 20, 21 and 23 sealed through the glass wall 24 of the tube. A similar external terminal 22 is initially coupled to another terminal with a metal getter, which is vaporized in the process of evacuating the tube. A glass filet 25 seals the inverter to the anode terminal 23. The exterior ends of the fibers in the inverter may be ground to a concave face 18 to match the spherical image plane of a suitable eyepiece (not shown).

To operate the tube, suitable voltages must be applied to the external electrodes and a light image projected on the external surface of the faceplate 11. As an example, the photocathode terminal 19 may be supplied with 1000 volts negative, the microchannel plate terminals 20 and 21 with zero and 700 volts positive, respectively, and the terminal 23 with 5700 volts positive. Thus electrons liberated from photocathode 13 by the photons of said light image are accelerated by the resulting electric fields and multiplied while ricochetting through the microchannel plate before striking the flourescent screen to form a greatly intensified image.

Figure 2:
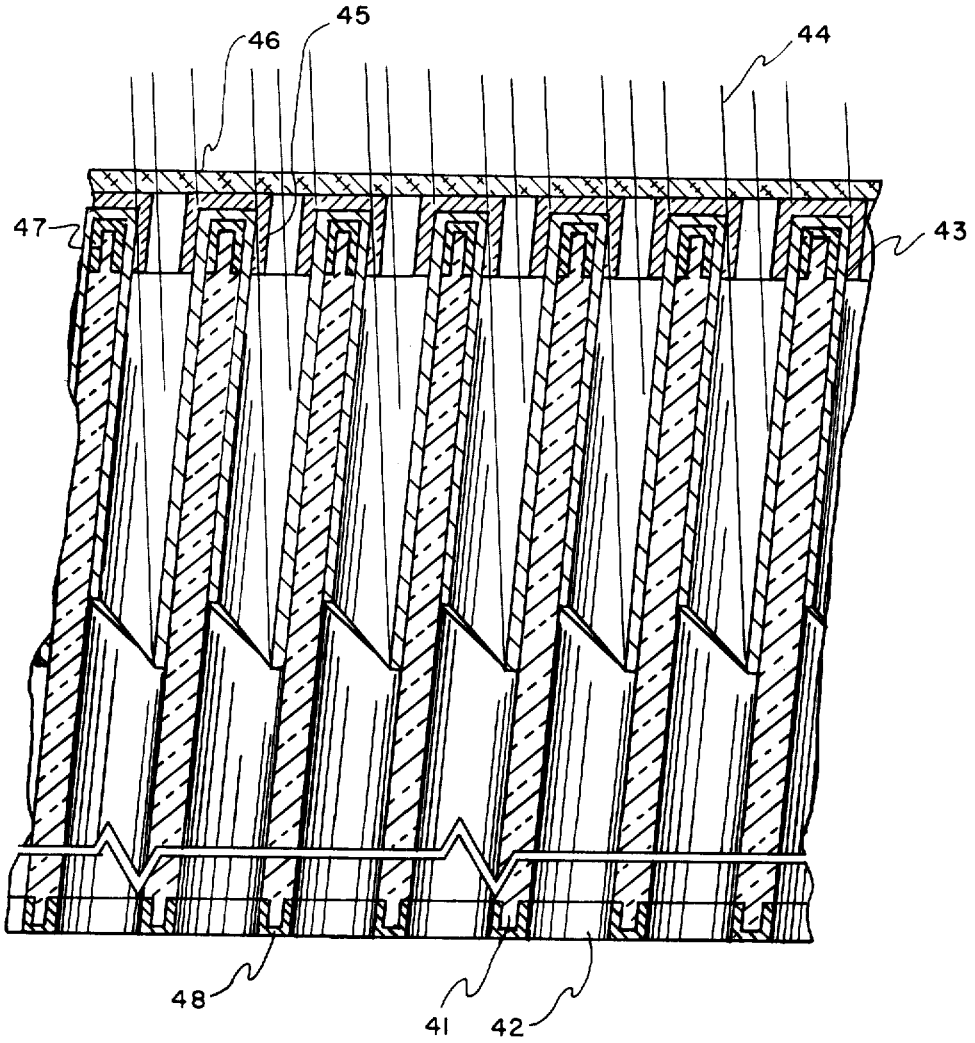
FIG. 2 shows a greatly enlarged cross-section of the microchannel plate from FIG. 1.

FIG. 2 shows an enlarged portion of the microchannel plate 11 from FIG. 1. The honeycomb core 41 is made of a conductive glass formed from individual fibers, each having a central aperture or channel 42, the fibers having been repeatedly heated and drawn together to form a single piece of glass. The apertures may be initially filled with a different type of material which has essentially the same drawing properties as the fibers, but has a physical and chemical structure such that it can be substantially removed by a suitable etching process. The channels are then scrubbed to remove any remaining impurities which could inhibit secondary emission or produce positive ion barbardment of the cathode. To apply accelerating fields through the channels each broad surface of the plate is coated with a thin layer of a good conductor 47 and 48 such as Inconel or Nichrome. This layer extends less than a channel diameter into each channel. The foregoing plate structure provides a fairly reliable electron multiplier provided the channels are slanted enough with respect to the accelerating electric field. The slant angle not only increases the probability that the electron passing through the channel will strike the wall near the input side of the plate but also does the same for any positive ions that the electrons release from any channel impurities. These may have remained therein as the tube was cleaned and outgassed. This technique is only practical in microchannel plates for small slant angles and there are still photoelectric events that produce too few electrons to insure an avalanche response in a channel.

The probability of no response to a single input event is dependent solely on the mean number of electrons produced in response to an input event, assuming Poisson statistics. Furthermore, the resolution depends largely on the number of electrons produced by the first input event. Thus, the properties of a multiplier can be improved by increasing the mean yield of electrons at the first multiplication point.

A technique for increasing the probability of response to a single input event according to the present invention is also shown in FIG. 2. A thin film 43 of a booster material with a high secondary emission ratio is applied to the input side of the channel plate 41 so as to coat the inside channel walls 42 down to a determined depth. Such material may be MgO, CsI or other alkali halide, or any other material or materials and which is compatible with the processing equipment and the other materials used to manufacture the plate and the electron tube. The effective depth is a function of the geometry of the channel plate. The plates now commercially available have a thickness of 20 mils, channel cross-sectional widths or diameters of 10–15 microns and slant angles at the channel input of 5°–6°. A suitable depth for these plates has been determined to be about 10 channel diameters. An increase in yield from 2 to 10 has been achieved using a film of CsI. Specifically, this may be accomplished by evaporation in vacuum onto the front surface of a microchannel plate from a first evaporation source of the above mentioned secondary emission materials. The angle of evaporation, i.e. the angular displacement of the evaporation source from the plate axis or channel's long axis as measured at the channel input, is chosen to produce the desired depth of coverage down the channels. The source is, of course, spaced from the plate orders of magnitude of the plate thickness. The angle of evaporation, as defined by the nearly parallel trajectories of the plating particles and either the normal to the plate or the long axes of the channel walls 42 thus becomes approximately arctan of $d/D$, where $d$ is the channel diameter and D is the effective depth of the coating. It is preferred that the source be small enough to be considered a point source and that the plate be rotated about an axis normal to the surface of the plate or about the channel axis during the evaporation. Although evaporation is most easily done, other methods such as gas phase combination may be employed. If the evaporation or deposition angle cannot be controlled, however, care must be taken to ensure that the entire surface of every channel is coated. A very thin overlaid film of conductive material 45 may be applied over the booster material to prevent a charge from forming on the channel wall. This would be necessary only for thick films of relatively poor conductors under conditions of high pulse rates. It is only necessary to coat the plate surface normal to the channel axis where a heavy deposit builds up, but some coating of the inside of the channel is tolerated as long as it does not extend more than a channel diameter into the channel. This can be achieved by locating a second evaporation source of the conductive material at about the same distance from the plate as the first source, but having the second further from the long axis of each channel than it is from the plate.

It is seen that the conductive glass matrix of the microchannel plate is responsible for replacing the charge lost to the pulse, and the function of the high secondary emission layer is not required to perform this function (as in U.S. Pat. No. 3,519,870 of Jensen). Thus, materials of high resistivity need not be excluded. This channel device can be incorporated into a vacuum tube body with certain tube processing steps, such as bake-out performed separately on the tube body prior to incorporating the device into the tube, thereby protecting the sensitive film from the rigors of tube processing.

A positive ion barrier layer 46 may be attached to the input force of the usual manner. This layer which may be aluminum oxide is thin enough to pass electrons readily, but prevents positive ions from bombarding the fragile photocathodes used in most image intensifiers.

While the invention has been described in combination with a specific wafer tube, it relates to any electron multiplier device having channels of the same order of magnitude. The device may be an imaging device, such as an inverter or proximity focus tube, or a non-imaging device such as a counter or detector. The multiplication may be produced by either discrete dynodes or a continuous element. There may be many channels such as a microchannel plate or only a single channel as in a simple multiplier.

We claim:

1. In a microchannel plate electron multiplier comprising a plurality of channels, each of said channels having a diameter on the order of 10–15 microns and a length on the order of about 20 mils, the channel wall comprising a conductive glass having a relatively low coefficient of secondary emission, the improvement comprising:

a first layer of booster material having a relatively high coefficient of secondary emission, and covering said wall from the microchannel plate input for a distance on the order of about 10 channel diameters.

2. An electron multiplier according to claim 1 wherein:

said booster material is coated with a second layer of a good conductor said second layer coating the entire input surface of the plate and extending into said channels less than the cross-sectional dimension of the channel.

3. An electron multiplier according to claim 1 wherein:

said booster material is cesium iodide.

4. An electron multiplier according to claim 1 wherein a base layer of highly conductive material is deposited only on portions of said walls covered by said second layer before said second layer is deposited.

* * * * *